US006729341B2

(12) United States Patent
Lee

(10) Patent No.: US 6,729,341 B2
(45) Date of Patent: May 4, 2004

(54) CONTROL APPARATUS FOR AN AUTOMATIC-OPENED UMBRELLA

(76) Inventor: Youth Lee, 6F-5, No. 164, Sec. 4, Nan Jin East Road, Taipei (TW)

( * ) Notice: Subject to any disclaimer, the term of this patent is extended or adjusted under 35 U.S.C. 154(b) by 86 days.

(21) Appl. No.: 10/113,980

(22) Filed: Apr. 2, 2002

(65) Prior Publication Data

US 2003/0183257 A1 Oct. 2, 2003

(51) Int. Cl.[7] ..... A45B 25/16
(52) U.S. Cl. ..... 135/24; 135/41
(58) Field of Search ..... 135/24, 22, 37, 135/38, 28, 39, 41, 42

(56) References Cited

U.S. PATENT DOCUMENTS 5,632,290 A * 5/1997 Ling Kuo ..... 135/24
5,992,433 A * 11/1999 Chung-Kuang et al. ..... 135/24
6,176,246 B1 * 1/2001 Lin et al. ..... 135/24
6,257,257 B1 * 7/2001 Shih ..... 135/24

* cited by examiner

*Primary Examiner*—Lanna Mai
*Assistant Examiner*—John Fitzgerald
(74) *Attorney, Agent, or Firm*—Rosenberg, Klein & Lee

(57) ABSTRACT

The present invention relates to a control apparatus for an automatic-opened umbrella, which includes a button with an inner ring body having two engaging ends. The umbrella is also provided with a runner with engaging edge on both sides. The runner will be securely engaged with the ring body of the control apparatus when the umbrella is closed. So the umbrella can prevent from accidentally opened in use that obtains a utilized effect.

2 Claims, 5 Drawing Sheets

CONTROL APPARATUS FOR AN AUTOMATIC-OPENED UMBRELLA

BACKGROUND OF THE INVENTION

A conventional automatic-opened umbrella is mainly provided with a control apparatus in a handle. As a runner of the umbrella is pulled down for closing, it will be engaged with the control apparatus. The umbrella can be opened by pressing a button on the handle to release the runner from the control apparatus. Since the engagement between the runner and the prior control apparatus is only by a single point, the umbrella may be accidentally opened because of intense of umbrella frame and the spring if the runner is rotated occasionally in use. This will cause much trouble and is lack of utility.

Accordingly, the primary object of the invention is to provide an improved control apparatus for an automatic-opened umbrella, which includes a couple of engaging ends to engage with the runner in secure during the umbrella is closed. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
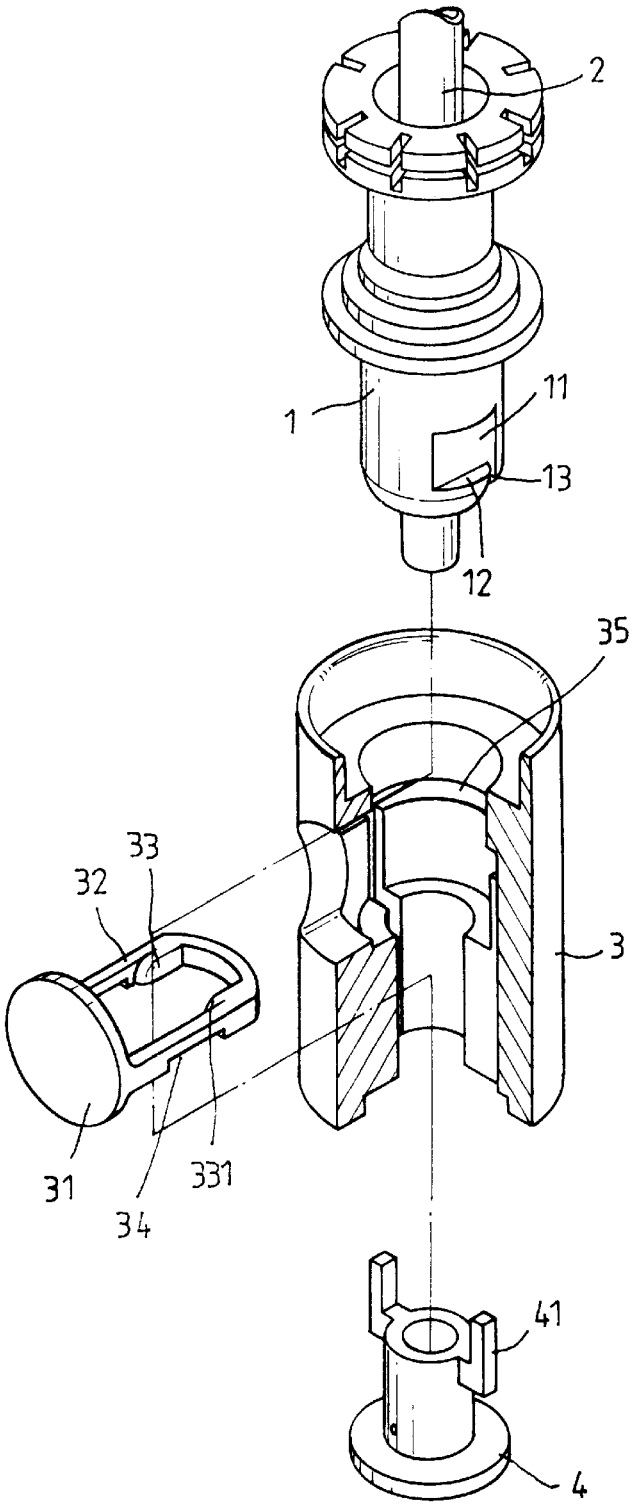
FIG. 1 is an exploded perspective view showing a control apparatus for an automatic-opened umbrella according to the present invention.
Figure 2:
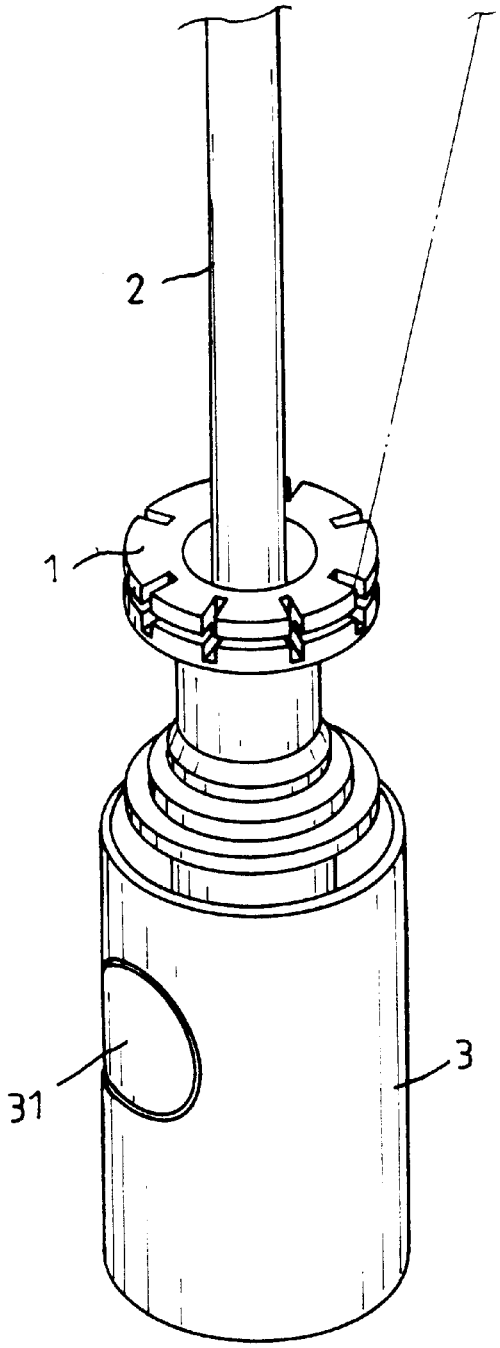
FIG. 2 is an assembled perspective view of FIG. 1.
Figure 4:
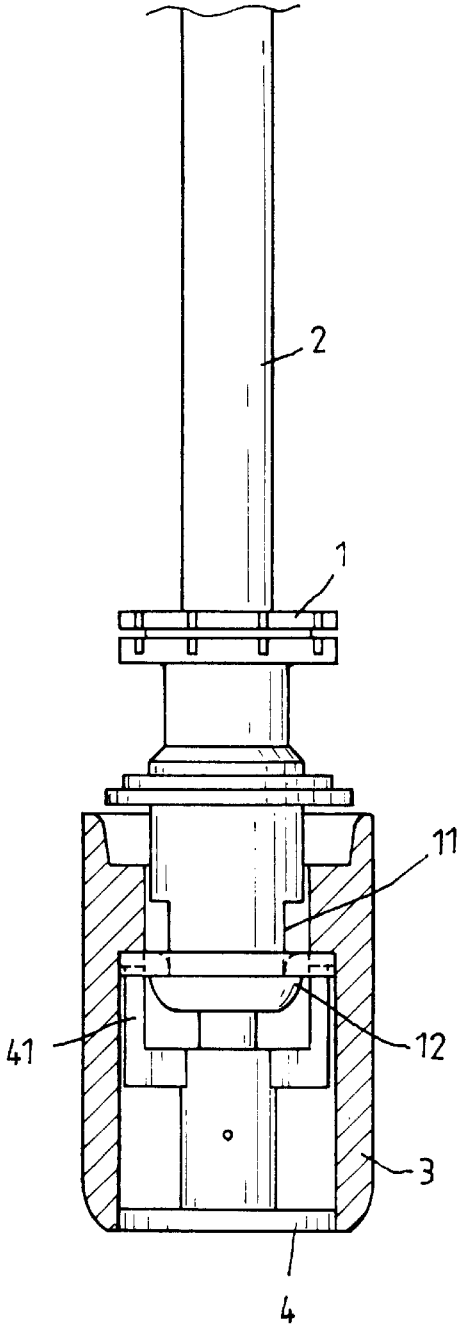
FIG. 4 is another cross-sectional plan view of FIG. 2, being perpendicular to FIG. 3.
Figure 3:
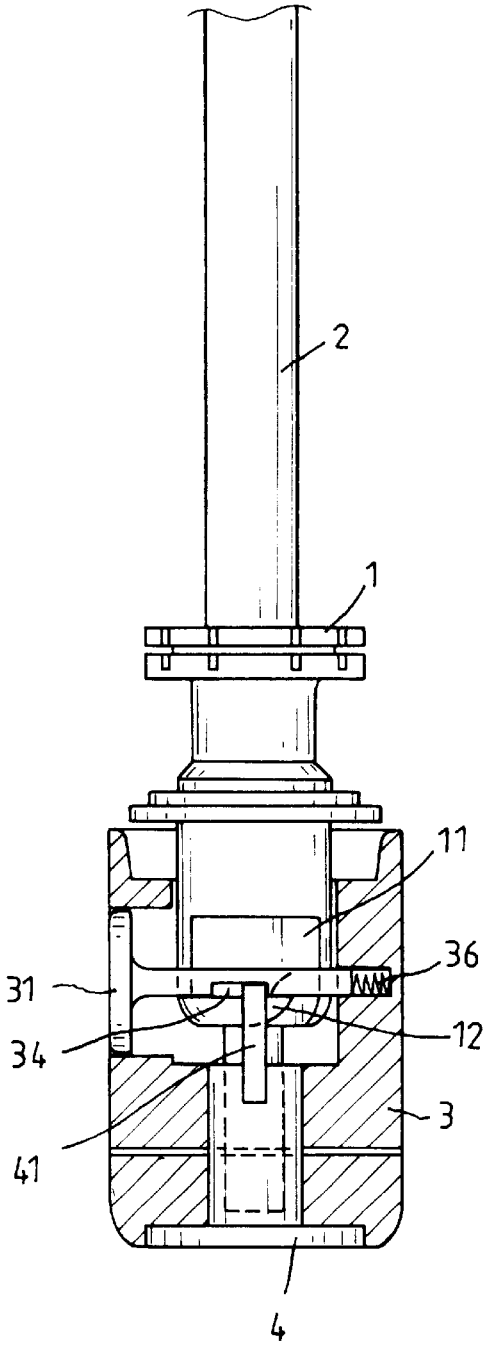
FIG. 3 is a cross-sectional plan view of FIG. 2.
Figure 6:
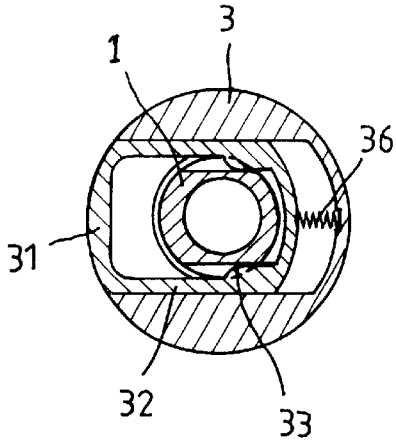
FIG. 6 is a horizontal cross-sectional plan view of FIG. 3.

Please refer to FIGS. 1 to 4, the present invention relates to an automatic-opened umbrella, which includes a runner (1) around a shaft (2). The shaft (2) has its lower end to penetrate a handle (3) and to connect with a seat (4). The runner (1) is provided with a respective flat portion (11) having a lower arched edge (12) and a passage (13) on either side of the runner (1). A button (31) has an inner ring body (32) provided in the handle (3) horizontally. The ring body (32) is penetrated by the shaft (2) and is provided with engaging end (33) having upper curved face (331) at both inner sides. Bottom of both sides of the ring body (32) is formed a groove (34). The seat (4) is provided with two upward rods (41) for positioning in the two grooves (34) of the ring body (32) that will keep the button (31) received in the handle (3) and never fallen out. A small spring (36) is placed in a channel (35) of the handle (3) to provide an elastic force on inner end of the ring body (32) that keeps the button (31) align with the handle (3). When the umbrella is closed, the two arched edges (12) of the runner (1) will thus be engaged with the two engaging ends (33) on the ring body (32) that obtains a firm engagement as shown in FIGS. 3, 4, and 6.

Figure 5:
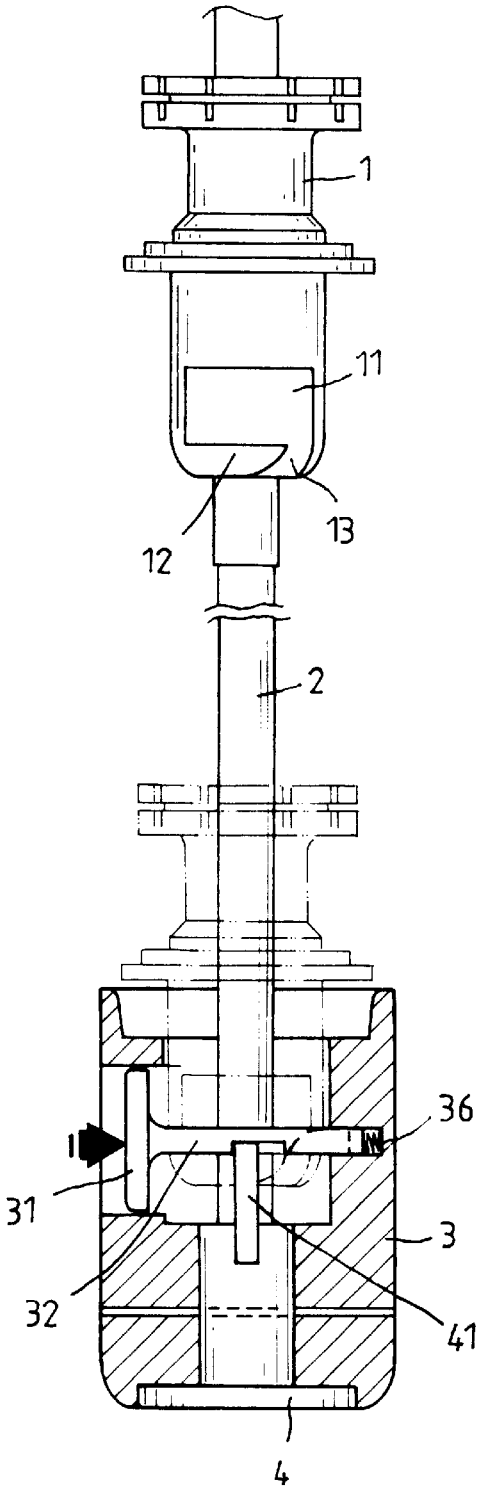
FIG. 5 is a plan view of FIG. 3 during opening the umbrella.
Figure 7:
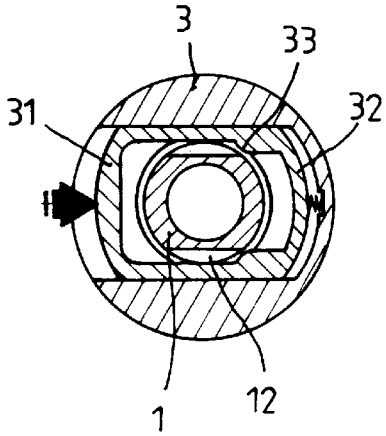
FIG. 7 is a plan view of FIG. 6 during opening the umbrella.

When to open the umbrella, user can just press the button (31) as in FIGS. 5 and 7. The engaging end (33) of the ring body (32) will be moved to a position of the passage (13) while the runner (1) is then released from engagement. So the runner (1) will be moved upward alone the shaft (2) and the umbrella can be automatically opened. Since the engagement between the runner and the control apparatus, i.e. the ring body, will be more secure because of both-side engaging, the closed umbrella according to this invention will never be accidentally opened that reaches the purpose of utility.

Figure 8:
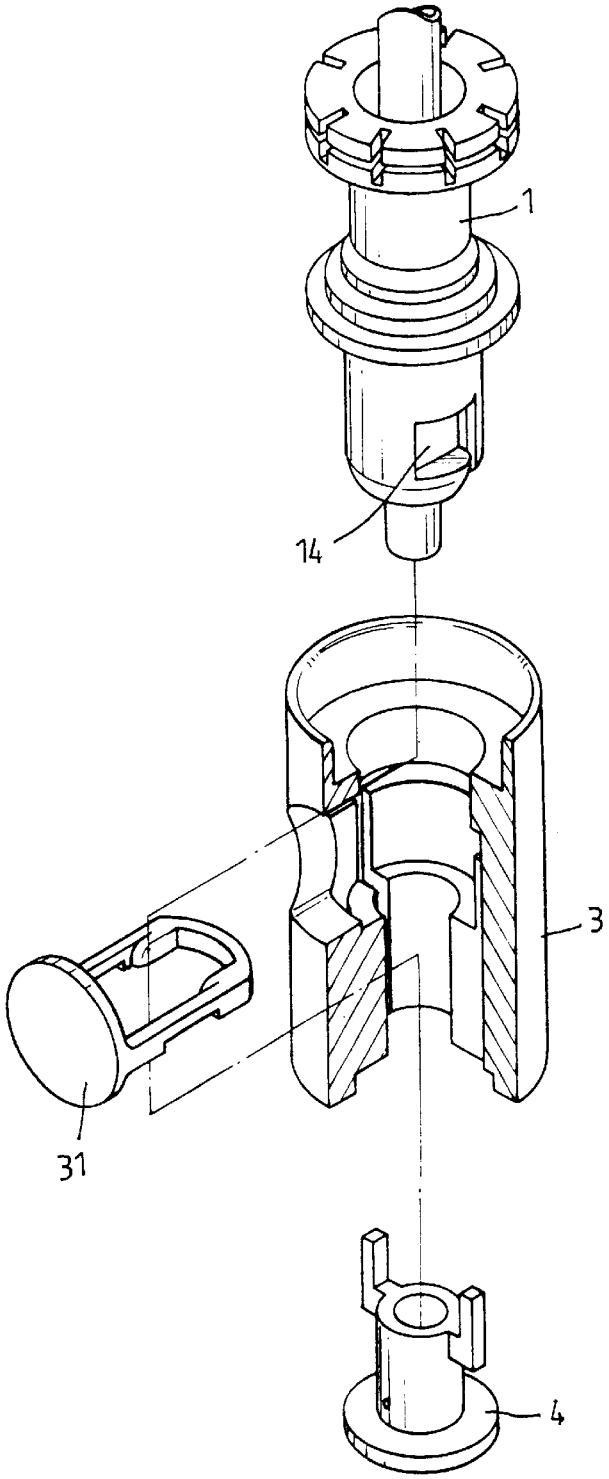
FIG. 8 is an exploded perspective view showing another embodiment of a control apparatus according to the present invention.

FIG. 8 shows another embodiment of the present invention. A modification is to provide an L-shaped flange (14) on both sides of the runner (1), which is concave for obtaining a better effect of engagement and increasing improvement of the umbrella.

Accordingly, the invented assembly of the present invention obviously obtains utility and improvement. It should be allowed for patent and is applied.

What is claimed is:

1. A control apparatus for an automatic-opened umbrella including a runner around a shaft having its lower end to penetrate a handle and to connect with a seat, and the characteristic is that the runner being provided with a respective flat portion having a lower arched edge and a passage on both sides of the runner, a button having an inner ring body provided in the handle horizontally; the ring body being penetrated by the shaft and being provided with engaging end having upper curved face at both inner sides, and a bottom of both sides of the ring body being formed a respective groove; the seat being provided with two upward rods for positioning in the two grooves of the ring body that keeps the button received in the handle and never falling out; a small spring being placed in a channel of the handle to provide an elastic force on an inner end of the ring body that keeps the button aligned with the handle; when the umbrella is closed, the two arched edges of the runner being thus engaged with the two engaging ends on the ring body that obtains a firm engagement.

2. The control apparatus for an automatic-opened umbrella as claimed in claim 1, wherein an L-shaped flange (14) being provided on both sides of the runner and being concave for engaging with the ring body firmly.

* * * * *